US007201126B1

(12) United States Patent
Seitz

(10) Patent No.: US 7,201,126 B1
(45) Date of Patent: Apr. 10, 2007

(54) ADJUSTABLE VALVE ROCKER LEVER

(75) Inventor: Joachim Seitz, Reundorf (DE)

(73) Assignee: Schaeffler KG (DE)

( * ) Notice: Subject to any disclaimer, the term of this patent is extended or adjusted under 35 U.S.C. 154(b) by 0 days.

(21) Appl. No.: 11/546,869

(22) Filed: Oct. 12, 2006

(30) Foreign Application Priority Data

Oct. 13, 2005 (DE) ..... 10 2005 048 984

(51) Int. Cl.
*F01L 1/18* (2006.01)

(52) U.S. Cl. ..... 123/90.39; 123/90.44; 74/569

(58) Field of Classification Search ..... 123/90.16, 123/90.2, 90.39, 90.44; 74/559, 569, 567
See application file for complete search history.

(56) References Cited

U.S. PATENT DOCUMENTS 4,617,880 A 10/1986 Yoshizaki
6,769,387 B2 * 8/2004 Hayman et al. ..... 123/90.39

FOREIGN PATENT DOCUMENTS

DE 696 14 166 T 2 3/1996
DE 696 02 152 T 2 9/1996
DE 696 15 329 T 2 11/1996
DE 697 00 480 T 2 2/1997
DE 10 2004 005 594 A1 2/2004
EP 0 747 575 A1 12/1996
FR 2 728 936 5/1996
WO WO 80/00094 1/1980
WO WO 2005/093224 A1 10/2005

* cited by examiner

*Primary Examiner*—Ching Chang
(74) *Attorney, Agent, or Firm*—Charles A. Muserlian

(57) ABSTRACT

An adjustable valve rocker lever (1) of a valve timing gear of an internal combustion engine, having an inner lever (3) and an outer lever (4) enclosing the former with its arms (2), the levers (3, 4) running on a common axis (5) so that they can swivel relative to one another and being connectable to one another by way of coupling links (6) in such a way that a large valve lift is generated when coupled and a comparatively smaller or zero valve lift is generated when decoupled, the inner lever (3) on an underside (7) at one end (8) of the axis (5) having a seating face (9) for an exhaust and refill valve and at the other end (10), a complementary face (11) for a support element, and at least the outer lever (4) having a lifting face (12) for a lifting cam, and a lost-motion spring (13) being provided between the levers (3, 4), the axis (5), viewed in the longitudinal direction of the valve rocker lever (1), being arranged between the seating face (9) for the exhaust and refill valve and a section directly in front of the lifting face (12) for the lifting cam on the outer lever (4), the lost-motion spring (13), viewed in the longitudinal direction, being positioned behind the axis (5), outside at the one end (8).

10 Claims, 2 Drawing Sheets

ADJUSTABLE VALVE ROCKER LEVER

FIELD OF THE INVENTION

The invention relates to an adjustable valve rocker lever of a valve timing gear of an internal combustion engine, having an inner lever and an outer lever enclosing the former with its arms, the levers running on a common axis so that they can swivel relative to one another and being connectable to one another by way of coupling links in such a way that a large valve lift is generated when coupled and a comparatively smaller or zero valve lift is generated when decoupled, the inner lever on an underside at one end of the axis having a seating face for an exhaust and refill valve and at the other end a complementary face for a support element, and at least the outer lever having a lifting face for a lifting cam, and a lost-motion spring being provided between the levers.

BACKGROUND OF THE INVENTION

Such a valve rocker lever is disclosed by the generic DE 103 10 226 A1. Viewed in the longitudinal direction of the valve rocker lever, its axis is arranged with the two lever parts at the one end behind the seating face for the exhaust and refill valve. Also noticeable is the fact that a swivel-leg spring is provided as lost-motion spring, which encloses the axis.

Several disadvantages are inherent in the aforementioned configuration. For one thing the axis relatively remote from the pivot point of the valve rocker lever increases the mass moment of inertia unnecessarily with relatively large moving masses on the valve side. Furthermore, the overall width of the aforementioned valve rocker lever is increased unnecessarily about the axis owing to the width required for the swivel-leg spring. As a result fitting problems can arise and it may be impossible to use the lever in engines of particularly compact dimensions. The axis relatively remote from the pivot point means that the outer lever also has an unfavorable deflection length.

OBJECT OF THE INVENTION

The object of the invention, therefore, is to create a valve rocker lever of the aforementioned type, in which the disadvantages cited are eliminated.

SUMMARY OF THE INVENTION

According to the invention this object is achieved in that the axis, viewed in the longitudinal direction of the valve rocker lever, is arranged between the seating face for the exhaust and refill valve and a section directly in front of the lifting face for the lifting cam on the outer lever, the lost-motion spring, viewed in the longitudinal direction, being positioned behind the axis, outside at the one end.

This eliminates the aforementioned disadvantages. The swiveling axis is now shifted significantly closer to the pivot point of the valve rocker lever. This is conducive to a compact construction of the aforesaid element. This arrangement of the swiveling axis serves to reduce the mass moment of inertia and the moving masses on the valve side.

According to the invention a rotationally stressed spring such as a helical compression spring is used as lost-motion spring, which viewed in the longitudinal direction is clamped behind the axis at the one end. A significantly narrower valve rocker lever can therefore be used, since this no longer requires the overall space in its width needed to accommodate the swivel-leg spring. It is also obvious that fitting of the helical compression spring will prove easier than in the case of the aforementioned swivel-leg spring.

It will moreover be noted that the outer lever possesses an improved rigidity, since its deflection length (when coupling) is reduced. Such a valve rocker lever can therefore also be used at higher engine speeds than that hitherto known in the state of the art.

Although said helical compression spring (at least one or a spring assembly) is preferably used as lost-motion spring, other spring devices such as disc springs etc. are also feasible. Other mechanical springs of the flexurally stressed or rotationally stressed type can also be fitted. Where necessary, magnetic, pneumatic or similar means are also feasible and provided for.

The valve rocker lever according to the invention may be adjustable to different cam contours or be entirely disconnectable from the cam lift. In the first case lifting faces on the upper sides of the arms of the outer lever communicate with corresponding main lift cams, whereas the inner lever on its upper side has a lifting face for a secondary lift cam. In the second case the outer lever again has the lifting faces for the respective main lift cams, whereas on the inner lever only a base circle or support cam rotates in opposition. In both variants, possible lifting faces generally include slide faces and/or rollers.

An easy possible way of arranging the lost-motion spring is set forth in a further subordinate claim. Said spring is accordingly clamped between seating faces, which extend virtually at right angles to the longitudinal center plane of the valve rocker lever, away from this at one end. At the same time the seating face of the inner lever may project in a cantilever-like design from its end face or an adjoining area and the seating face of the outer lever may take the form of a regular cross web at the one end, which connects the side walls of the outer lever and on its underside moreover has the seating face for the exhaust and refill valve.

The shoulder which projects perpendicularly from the cross web of the inner lever and which on its upper side merges into the extension with first seating face, is preferably integrally joined to the cross web at one end of the inner lever. Where the inner lever is made from sheet metal material, this cantilever-like design may be formed on during the stamping/bending process.

In one embodiment of the invention each of the seating faces has a separate spring plate for direct seating of the lost-motion spring. At least one of these spring plates is variable in its fitting depth so as to be able, where necessary, to adjust the force of the lost-motion spring more precisely. This therefore affords the lost-motion spring a very secure, wear-resistant seating on the respective counter-pieces at the end.

The aforementioned spring plates may be solid or may be composed, for example, of an extruded sheet metal material. An easy method of fixing these is to provide them with domed shoulders, which run in the respective bores in the seating faces. At least one of the lever parts should suitably be made from a sheet metal material. However, both lever parts are advantageously made from sheet metal and mass produced by stamping and bending. Among other things, this has manufacturing advantages over forming techniques in terms of production costs.

The box-like profile of the outer lever produced according to a further subordinate claim is especially easy to manufacture by chipless, non-cutting methods. The lifting faces (slide faces) are suitably also integrally formed onto upper sides of the side walls of the outer lever.

According to a further embodiment of the invention the arms of the outer lever are connected at the other end by a belt-like cross member. The outer lever therefore has good stability. In addition, an underside of the cross member affords an excellent seating face for sections of the coupling link when coupled (large cam lift). Here a longitudinally displaceable element is proposed as coupling link, which advantageously runs inside the inner element above the complementary face for the support element and is for example hydraulically displaceable in at least one direction. Also feasible, however, are transversely displaceable coupling links or other forms of actuation for the coupling links such as electromagnetic means etc.

BRIEF DESCRIPTION OF THE DRAWING

The invention is suitably explained in more detail with reference to the drawing, in which.

DETAILED DESCRIPTION OF THE DRAWING

Figure 3:
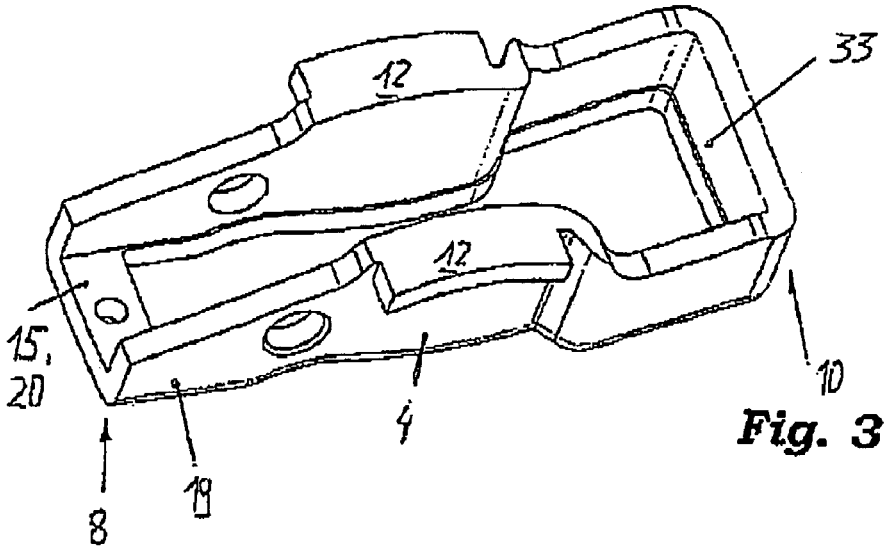
FIG. 3 shows a three-dimensional view of the outer lever.

The figures show an adjustable valve rocker lever 1 of a valve timing gear of an internal combustion engine. The valve rocker lever 1 comprises an outer lever 4 of box-like design, which with its arms 2 encloses an inner lever 3. Both levers 3, 4 run on a common axis 5 on the side of one end 8. At the one end 8 the outer lever 3 (see also FIG. 3) is connected by a cross web 20, which at the same time on its upper side affords a one-ended seating face for a lost-motion spring 13 (see below). This cross web 20 connects the arms 2 of the outer lever 4 in the area of their underside 19.

In the area of another end 10 the arms 2 of the outer lever 4 have a belt-like connection in the form of a cross member 33. The underside thereof serves when coupling for sectional support of a coupling link 6 fitted in the inner lever 3.

Figure 4:
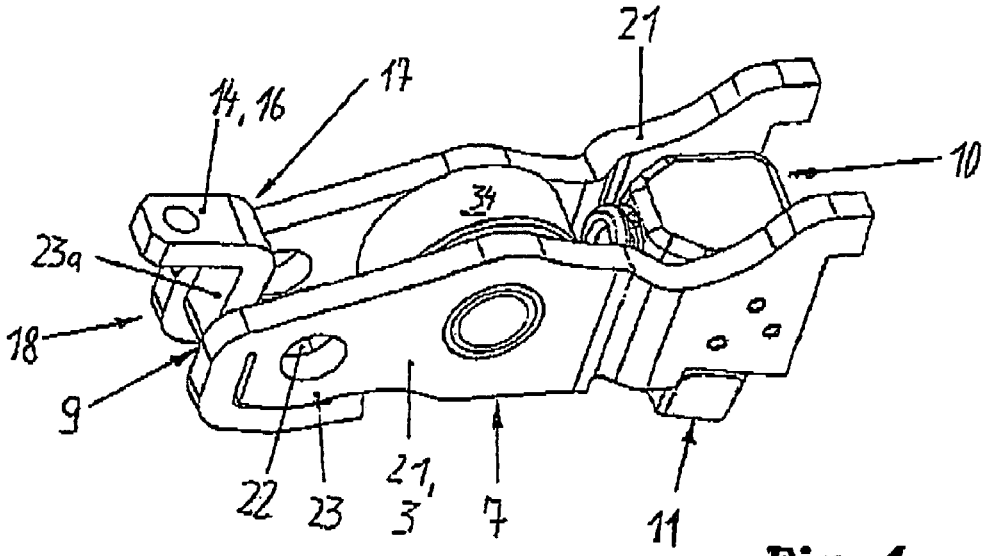
FIG. 4 shows a three-dimensional view of the inner lever.

As FIG. 4 shows, the inner lever 3 comprises two upright side walls 21. In the area of one end 8, these walls are connected by a cross web 22 in their lower area 23. The underside 7 of the inner lever 3 has two further major components. Firstly a seating face for an exhaust and refill valve is generated on the cross web 22 in the area of one end 8. At the other end 10 the inner lever 3 has a complementary face 11 for resting on a head of an exhaust and refill valve. Above this complementary face 11 the here longitudinally displaceable coupling link 6 runs in a corresponding seat.

FIG. 4 also shows that a lifting face 34 for a low-lift cam is provided in the inner lever 3. This is represented here as a rotatable roller.

Figure 1:
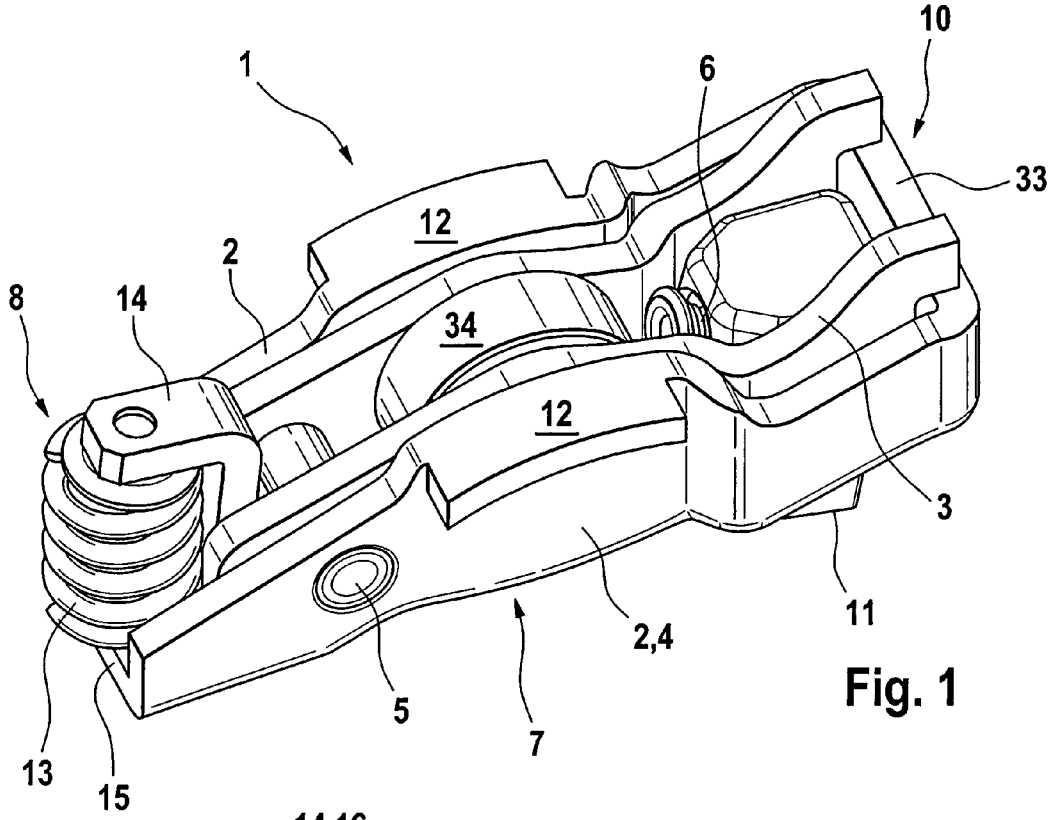
FIG. 1 in a three-dimensional view shows the adjustable valve rocker lever with inner and outer lever.
Figure 2:
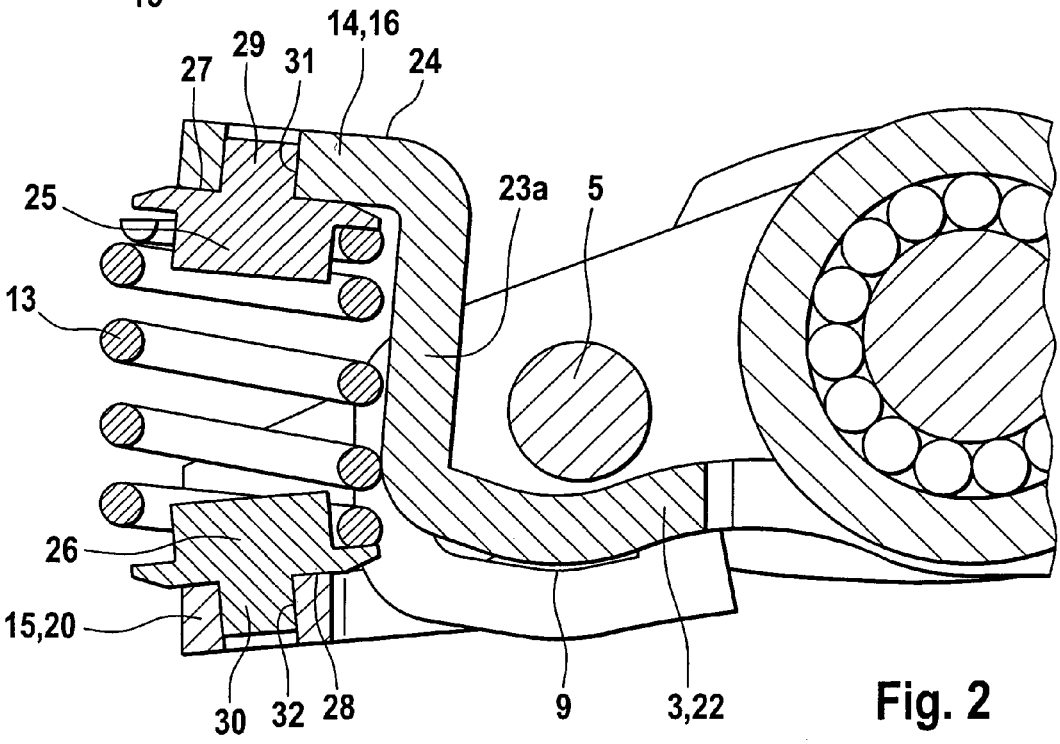
FIG. 2 shows a partial longitudinal section through the inner lever in the area of one end.

As can be seen from FIGS. 1, 2, the axis 5, viewed in the longitudinal direction of the valve rocker lever 1, is arranged between the seating face 9 for the exhaust and refill valve and a section directly in front of the respective lifting face 12 for the lifting cam on the outer lever 4. This "inward shifting" of the axis 5 compared to the state of the art cited in the introductory part of the description means that the moving masses on the valve side are reduced. It is clear that the axis 5 cannot be shifted infinitely far away towards the other end 10, in order to ensure a correction functioning of the lever parts.

It can moreover be seen that in the area of one end 8 the lost-motion spring 13 runs, behind the axis 5 when viewed in the longitudinal direction of the valve rocker lever 1. This spring is here represented as a helical compression spring. The helical compression spring consequently replaces the swivel leg spring disclosed in the state of the art. The valve rocker lever 1 may be made with a narrower overall design.

As shown in more detail by FIG. 2, the lost-motion spring 13 runs between seating faces 14, 15 on the inner lever 3 and the outer lever 4. At the same time an integrally formed shoulder 23*a* extends vertically upwards from the cross web 22 of the inner lever 3 with the seating face 9 for the exhaust and refill valve. This shoulder is provided on its upper side 24 with a projecting extension 16. This extension 16 has the seating face 14. The lost-motion spring 13 rests directly on the seating face 14 by way of one face 27 of a separate spring plate 25. The spring plate 25 is provided with a domed shoulder 29, which is seated in a corresponding bore 31 in the seating face 14. The components 23*a*, 16 are suitably integrally formed with the cross web 22, the shoulder 23*a* running between the side walls 21 of the inner lever 3.

The seating face 15 on the outer lever 4 has a bore 32, in which a spring plate 26 runs for supporting the other end of the lost-motion spring with its domed shoulder 30. The spring plate 26 is therefore in turn seated with its face 28 on the seating face 15 on the cross web 20.

The inner lever 3 and outer lever 4 are preferably produced from thin-walled sheet metal material in a stamping/bending process. To represent the seating face 14 on the extension 16, this can project directly from the upper area 17 of an end face 18 of the inner lever 3 at the one end 8, or it may be formed separately.

LIST OF REFERENCE NUMERALS

1) valve rocker lever
2) arm
3) inner lever
4) outer lever
5) axis
6) coupling link
7) underside
8) one end
9) seating face
10) other end
11) complementary face
12) lifting face
13) lost-motion spring
14) seating face
15) seating face
16) extension
17) area
18) end face
19) underside
20) cross web
21) side wall
22) cross web
23) area
23*a*) shoulder
24) upper side
25) spring plate
26) spring plate
27) face
28) face

29) shoulder
30) shoulder
31) bore
32) bore
33) cross member
34) lifting face

The invention claimed is:

1. An adjustable valve rocker lever (1) of a valve timing gear of an internal combustion engine, having an inner lever (3) and an outer lever (4) enclosing the former with its arms (2), the levers (3, 4) running on a common axis (5) so that they can swivel relative to one another by way of coupling links (6) in such a way that a large valve lift is generated when coupled and a comparatively smaller or zero valve lift is generated when decoupled, the inner lever (3) on an underside (7) at one end (8) of the axis (5) having a seating face (9) for an exhaust and refill valve and at the other end (10) a complementary face (11) for a support element, and at least the outer lever (4) having a lifting face (12) for a lifting cam, and a lost-motion spring (13) being provided between the levers (3, 4), wherein the axis (5), viewed in the longitudinal direction of the valve rocker lever (1), is arranged between the seating face (9) for the exhaust and refill valve and a section directly in front of the lifting face (12) for the lifting cam on the outer lever (4), the lost-motion spring (13), viewed in the axis (5), outside at the one end (8).

2. A valve rocker lever of claim 1, wherein the lost-motion spring (13) is clamped between a seating face (14, 15) on the inner and outer levers (3, 4) running approximately at right angles to a longitudinal center plane of the valve rocker lever (1), the first seating face (14) being formed on what is, when viewing the inner lever (3) from the side, an arm-like extension (16) of an upper area (17) of an end face (18) of the inner lever (3) at the one end (8), the second seating face (15) being formed on a cross web (20) connecting the arms (2) of the outer lever (4) to the one end (8) on the underside (19) thereof and the one end face (18) of the inner lever (3) extending to directly in front of the cross web (20) of the outer lever (4).

3. A valve rocker lever of claim 2, wherein the inner lever (3) comprises two substantially upright and thin-walled side walls (21), which at least in the area of the one end (8) are connected to on another by a cross web (22) in their lower area (23), said cross web (22) having the seating face (9) for the exhaust and refill valve on the underside (7) and outside, viewed in the longitudinal direction, merging integrally into a shoulder (23*a*) pointing approximately vertically upwards, from the upper side (24) of which shoulder the extension (16) with the first seating face (14) is bent in one piece.

4. A valve rocker lever of claim 1 wherein the lost-motion spring (13) takes the form of at least one rotationally stressed spring such as a helical compression spring.

5. A valve rocker lever of claim 4, wherein the seating faces (14, 15) are provided with separate spring plates (25, 26), on which the lost-motion spring (13) is supported at either end.

6. A valve rocker lever of claim 5, wherein on at least one seating face (14, 15) a disc-like body is provided as spring plate (25, 26), to the end face (27, 28) of which facing the respective seating face (14, 15) a concentric shoulder (29, 30) is applied, which is located in a bore (31, 32) in the seating face (14, 15).

7. A valve rocker lever of claim 1, wherein the outer lever (4) in plan view forms a box-like profile.

8. A valve rocker lever of claim 7, wherein the arms (2) of the outer lever (4) at the other end (10) have a belt-like connection in the form of a cross member (33), a piston-like element, which is displaceable in the longitudinal direction of the valve rocker lever (1) and which for coupling can in sections be slid under the cross member (33), is fitted as coupling link (6) in the inner lever (3), in the areas above its complementary face (11) for the support element.

9. A valve rocker lever of claim 1 wherein the arms (2) of the outer lever (4) at the other end (10) have a belt-like connection in the form of a cross member (33), a piston-like element, which is displaceable in the longitudinal direction of the valve rocker lever (1) and which for coupling can in sections be slid under the cross member (33), is fitted as coupling link (6) in the inner lever (3), in the areas above its complementary face (11) for the support element.

10. A valve rocker lever of claim 1, wherein at least one of the levers (3, 4) is composed of thin-walled sheet metal and is formed in a stamping/pending process.

* * * * *